United States Patent [19]

Kinard

[11] Patent Number: 4,532,745

[45] Date of Patent: Aug. 6, 1985

[54] CHANNEL AND FOAM BLOCK WALL CONSTRUCTION

[75] Inventor: George P. Kinard, Arvada, Colo.

[73] Assignee: Core-Form, Broomfield, Colo.

[21] Appl. No.: 330,174

[22] Filed: Dec. 14, 1981

[51] Int. Cl.[3] ..... F04B 2/24

[52] U.S. Cl. ..... 52/251; 52/367; 52/364; 52/439; 52/309.12; 52/309.13

[58] Field of Search ..... 52/309.13, 406, 405, 52/586, 585, 309.12, 364, 367, 259, 251, 439

[56] References Cited

U.S. PATENT DOCUMENTS

| | | | |
|---|---|---|---|
| 1,307,779 | 6/1919 | Johnson | 52/439 |
| 1,350,019 | 8/1920 | Harkness | 52/439 |
| 1,499,171 | 6/1924 | Green . | |
| 1,501,288 | 7/1924 | Morley | 52/236.8 |
| 1,583,077 | 5/1926 | Long . | |
| 1,757,077 | 5/1930 | Eiserloh | 52/262 |
| 1,930,951 | 10/1933 | Dotson | 52/439 |
| 2,233,089 | 2/1941 | Adler | 52/439 |
| 2,326,708 | 8/1943 | Wanner | 52/439 |
| 2,776,559 | 1/1957 | Summers | 72/30 |
| 2,841,975 | 7/1958 | Bruckmayer | 52/439 |
| 2,911,817 | 11/1959 | Smith | 52/439 |
| 3,076,293 | 2/1963 | Baudoux | 52/439 |
| 3,127,702 | 4/1964 | Karstedt | 50/321 |
| 3,255,562 | 6/1966 | Altschuler | 52/309 |
| 3,292,331 | 12/1966 | Sams | 52/405 |
| 3,383,817 | 5/1968 | Gregori | 52/309 |
| 3,389,521 | 6/1968 | Gregori | 52/309 |
| 3,410,044 | 11/1968 | Moog | 52/309 |
| 3,420,023 | 1/1969 | Gregori | 52/309 |
| 3,511,000 | 5/1970 | Keuls | 52/586 |
| 3,552,076 | 1/1971 | Gregori | 52/309 |
| 3,717,967 | 2/1973 | Wood | 52/439 |
| 3,782,049 | 1/1974 | Sachs | 52/309 |
| 3,788,020 | 1/1974 | Gregori | 52/309 |
| 3,800,014 | 3/1974 | Sachs | 264/45 |
| 3,950,902 | 4/1976 | Stout | 52/262 |
| 3,979,867 | 9/1976 | Sowinski | 52/309 |
| 4,038,798 | 8/1977 | Sachs | 52/309 |
| 4,091,587 | 5/1978 | Depka | 52/439 |
| 4,112,646 | 9/1978 | Clelland | 52/372 |
| 4,163,349 | 8/1979 | Smith | 52/241 |
| 4,211,385 | 7/1980 | Johanson | 249/192 |
| 4,223,501 | 9/1980 | DeLozier | 52/309 |
| 4,249,354 | 2/1981 | Wynn | 52/309.12 |
| 4,314,431 | 2/1982 | Rabassa | 52/439 |
| 4,461,130 | 7/1984 | Shubow | 52/236.8 |

FOREIGN PATENT DOCUMENTS

| | | | |
|---|---|---|---|
| 826584 | 11/1969 | Canada | 25/83 |
| 838601 | 4/1970 | Canada | 25/83 |

*Primary Examiner*—John E. Murtagh
*Assistant Examiner*—Kathryn L. Ford
*Attorney, Agent, or Firm*—John R. Ley

[57] ABSTRACT

A generally U-shaped channel member is positioned on top of the top surface of a plurality of foam plastic blocks in a horizontal wall segment, and vertically aligned concrete confining openings are formed through both the channel member and the plastic blocks. Concrete or the like is poured into the U-shaped channel and is funneled therefrom into the vertical openings. Once the concrete sets as a rigid supporting structure, the U-shaped channel is permanently retained in the wall structure. The U-shaped channel member is employed for attaching means to the exterior of the completed wall structure. Additional horizontal segments of the wall structure are formed by placing another horizontal layer of plastic blocks and a U-shaped channel member on top of the previously completed horizontal segment.

32 Claims, 10 Drawing Figures

CHANNEL AND FOAM BLOCK WALL CONSTRUCTION

This invention pertains to, and is useful for, building and housing construction. More specifically, this invention pertains to improvements in a type of construction wherein wall structures are constructed using foam plastic blocks and concrete is poured into openings in blocks. The concrete forms the rigid structural support for the wall section after it hardens. The blocks serve initially as forms for confining the fluid concrete, and thereafter as highly effective thermal insulation. External coverings, such as wall board or drywall sheets, are thereafter connected to the foam plastic blocks to finish the wall section.

Building with foam plastic blocks and poured concrete is well known, and use of the technique has resulted in moderate success. However, there are certain limitations and disadvantages inherent in all known prior building techniques of this type.

One notable limitation in prior foam block and poured concrete construction is a difficulty in attaching other structural and external members, such as floor and ceiling joists and wall finishing materials, to the exterior surfaces of the foam blocks. Typically, the prior foam blocks are intended to be stacked and interconnected with one another and on top of one another for the full height and width of the wall structure. The interfitting relationship of the adjacent blocks is critical for confining the concrete during pouring and hardening. The concrete may be poured in layers as each horizontal segment of the blocks is layed up. The resulting complete wall structure lacks readily convenient means for attaching exterior materials thereto because the exterior of the wall segment is all foam plastic. Although some relatively lightweight wall covering material, such as wallboard, can be glued directly onto the exterior surface of the foam blocks, substantial structural elements, such as floor joists, can not. To connect floor joists in the past, it has been necessary to attempt to attach hangers to the interior concrete reinforcement, either prior to pouring or after the concrete has set. In either event, it is necessary to cut away a segment of the foam block to gain access to the concrete confining opening in the block. Cutting away the foam block requires extra effort and skill and results in increased building costs and time. Frequently, the openings cut in the foam blocks are improper in shape and configuration and thereby allow the poured concrete to leak out. Some means, usually extra bracing or support, is thereby required to confine the poured concrete within the foam block and prevent it from leaking. Attaching hangers to the solidified concrete within the block is inconvenient and requires extra time for construction and results in extra expense. Special adjustments in the width and height of prior foam blocks are required to form a horizontal shelf ledge or support for supporting brick layed up along the exterior surface of the foam blocks. To construct the ledge or attach the support, substantial modifications to the foam blocks must be made in the manner in which they interconnect with one another and to allow the concrete to form the support ledge or means for attaching the shelf support. Such special modifications entail substantial effort and expenditure of time and result in an increase in building costs. To form a stucco or similar covering on the prior foam blocks requires the wiring of lath or wire mesh through the foam blocks to means on the opposite side of the block or to the concrete within the interior openings.

Another disadvantage of prior foam block and poured concrete construction is that the foam blocks are intended to interconnect with one another, both vertically and horizontally. Various interfitting means, such as tongues and grooves, are provided. When it is necessary to cut or trim the blocks during construction, the normal interfitting relationship is disturbed. Special modifications are thereafter required to reestablish the interfitting relationship. Furthermore, the interfitting relationship is normally critical to confining the concrete to the interior openings. Typically, the interfitting means are of less thickness than the remaining portions of the foam block and therefore are subject to easy breakage. The weight of the poured concrete also tends to force these limited thickness areas outward and disturb what would otherwise be a normally smooth planar exterior wall surface of the foam blocks. Protrusions and bulges make attaching wallboard and drywall covering materials very difficult. The poured concrete frequently leaks from the interfitting areas either because of damage thereto or because of a lack of strength to confine the foam blocks together and the concrete therein.

Another important limitation in foam block and poured concrete construction is that certain types of prior foam blocks are actually two separate halves which are joined together. The two halves may be joined together by relatively thin metallic pieces which extend between the halves, or the interfitting relationship is supposed to maintain the halves together with only a minimum amount of exterior bracing. Frequently, the thin metallic connectors pull away from one of the walls under the weight of the concrete poured in the interior openings. Experience has shown that considerably more exterior bracing is required than had been originally anticipated in such prior building techniques.

Other limitations and disadvantages of prior foam block and poured concrete construction arrangements are known.

INVENTION SUMMARY

Certain improvements of the present invention pertain to providing a plastic block and poured concrete method and apparatus wherein there is provided an efficient means for attaching various types of materials and coverings to the exterior of the wall, while maintaining a consistent, uninterrupted, and efficient technique in constructing the wall. In one broad aspect, the present invention employs a generally U-shaped channel member placed during construction of the wall structure on the top of each horizontal layer of plastic blocks. The U-shaped channel member extends adjacent to the exterior surface of the blocks and allows various fasteners to be attached directly to the channel member. After the poured concrete hardens, the channel member is held permanently and rigidly in position in the wall structure. The various materials and coverings can be directly attached to the channel member. In situations where a shelf support or ledge is required, the U-shaped channel member is extended outward past the exterior wall of the block and is filled with concrete during pouring to inherently provide a ledge or shelf support.

Openings are formed in a lower horizontal wall of the channel member. These openings are aligned with vertically extending concrete confining openings formed in the plastic blocks. Preferably, the blocks are of unitary, single-piece construction and abut against adjacent blocks of the same construction. The vertically extending concrete confining openings are located interiorly with respect to the exterior surfaces of the block and play no part in interconnecting with other blocks. The integral strength of each block is available to restrain the weight of the concrete poured within its interior concrete confining openings. Side walls extend upward from the bottom wall of the channel member. The side walls serve to funnel the concrete poured into the channel member into the openings in the bottom wall and into the concrete confining openings of the blocks. The concrete is more quickly and conveniently directed into the openings. When the concrete confining openings of the blocks are filled, the upward opening U-shaped channel defined by the side and bottom walls is also filled with concrete. A horizontal beam is produced which separates each horizontal layer of the wall segment from the next horizontal layer. After one horizontal layer is complete, the next horizontal layer is formed by laying up the next vertically spaced horizontal layer of blocks and the next channel member. No interfitting of the blocks is required. The concrete confining openings in the blocks are of high strength since they are formed integrally in the block and do not depend on any connection with any other foam blocks for their integrity. Any bracing required during the building is simply and quickly attached to the side walls of the channel member by nailing or the like. Cutting openings in the block is not required because the channel members provide a quick convenient means for connecting exterior materials to the wall segment. Many other significantly improved features and advantages are available from the invention, and are described in the following detailed description of a preferred embodiment and in the drawings.

DRAWING DESCRIPTION

PREFERRED EMBODIMENTS

Figure 1:
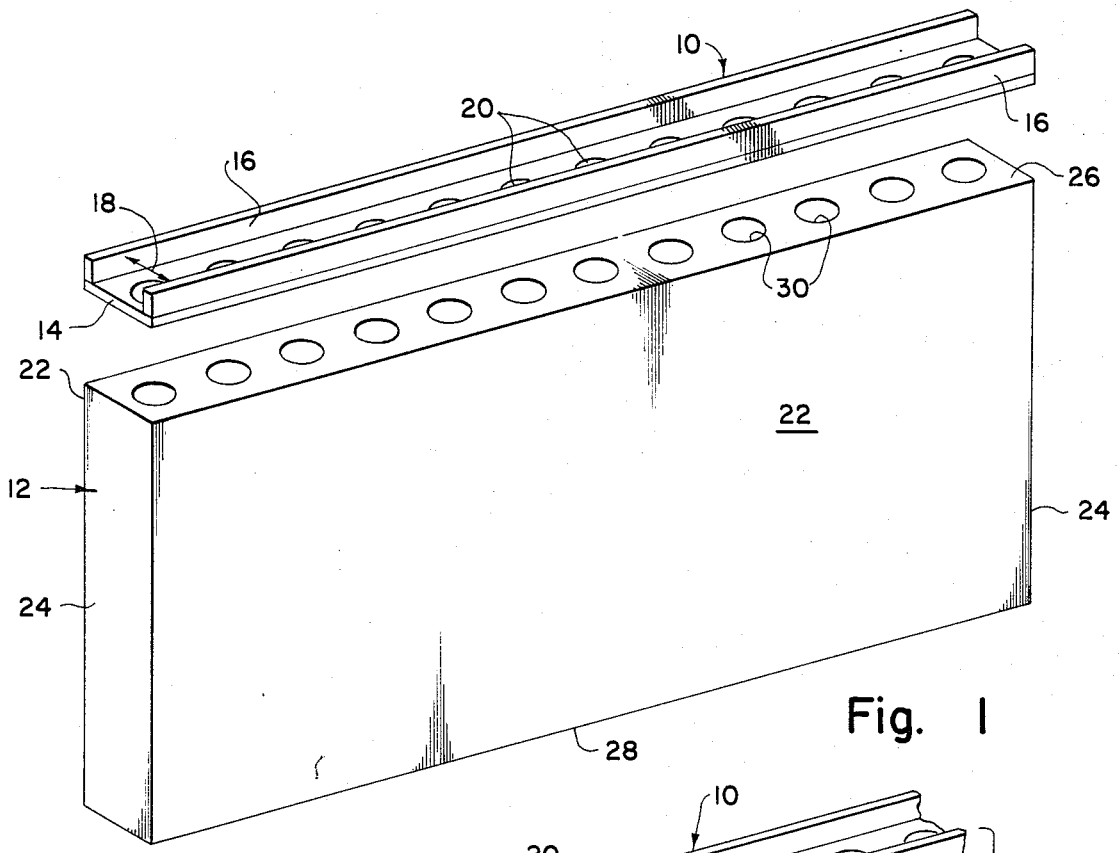
FIG. 1 is a perspective view of a channel member and a foam plastic block of the present invention shown in exploded relation.

Preferred embodiments of a channel member 10 and a foam plastic block 12 are illustrated in FIG. 1. The channel member 10 is defined by a lower bottom wall member 14 and upstanding side wall members 16 are connected on opposite transverse sides of the bottom wall. The side walls 16 and bottom wall 14 define an upward opening U-shaped channel 18. Circular holes or channel openings 20 are formed completely through the bottom wall 14 in the U-shaped channel 18 between the side walls 16 and at predetermined intervals along the length of the channel member 10. The bottom wall is preferably formed of pressure-treated plywood, and the side walls are preferably formed of pressure-treated lumber, although other types of materials can be utilized. For example, the side walls 16 could be formed by or with any type of relatively strong material or means to which fasteners, such as nails and screws, could be attached or connected.

The plastic block 12 is preferably of right rectangular configuration. Described in relation to its orientation during use, as shown generally in FIG. 1, the block 12 includes two parallel, planar, vertically-extending, opposite, exterior surfaces 22; two parallel, planar, vertically-extending, opposite end surfaces 24; and a planar top surface 26 which is opposite of and extends parallel to a planar bottom surface 28. The length of the block 12 along a longitudinal dimension is defined by the distance between the surfaces 24. The thickness of the block 12 along a width dimension is defined by the distance between surfaces 22. The height of the block along a height dimension is defined by the distance between surfaces 26 and 28. Cylindrical-like block openings 30 are formed in the block 12 and extend completely through the block 12 between the top wall 26 and bottom wall 28. The block openings 30 extend parallel in both of the planes defined by the exterior walls 22 and end walls 24. The interval or spacing between the centers of each block opening 30 is predetermined and is the same as the predetermined interval or spacing between the channel openings 20 in the channel member 10. The diameter of the block openings 30 is preferably the same as the diameter of the circular channel openings 20. The blocks 12 are preferably formed of expanded bead polystyrene plastic, although other types of plastic can be used. It is desirable that the plastic of the blocks 12 have a high insulating capacity since, it will be seen, the block 12 is utilized in a completed wall structure essentially as a thermal insulating material, and not as a load-bearing element.

Figure 2:
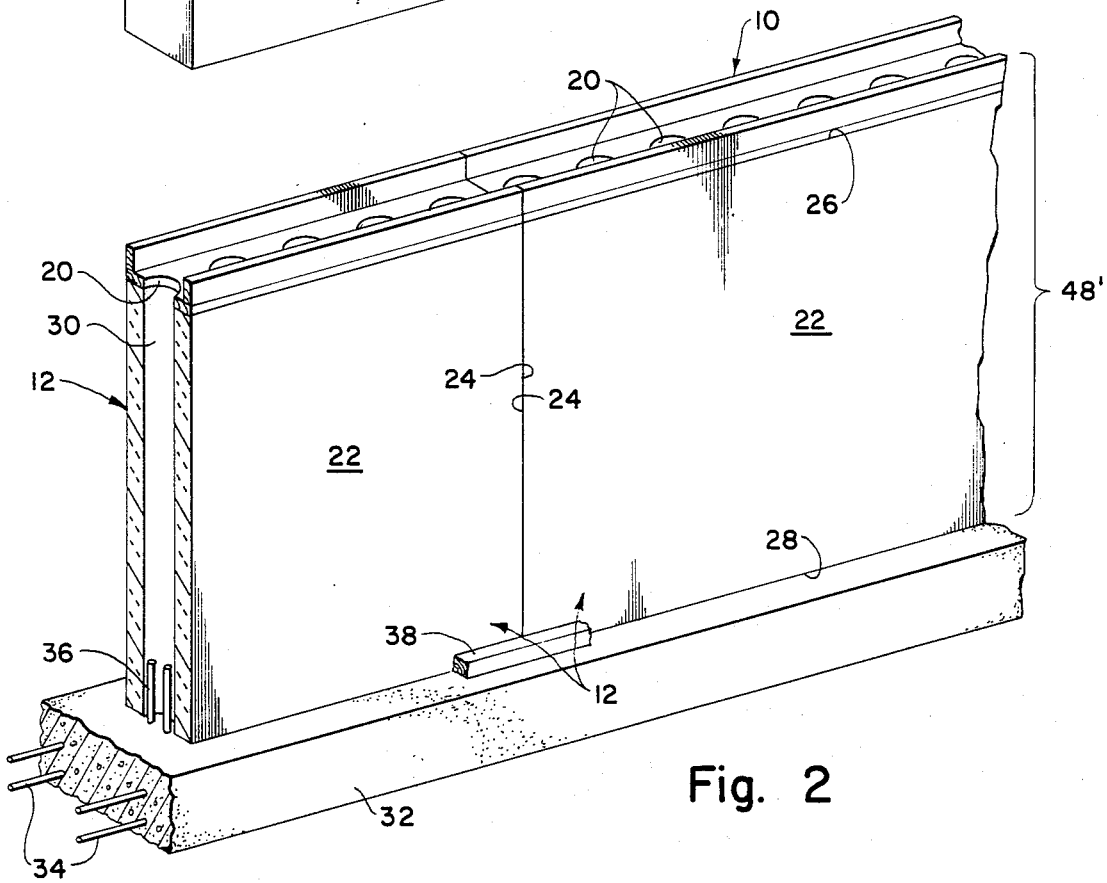
FIG. 2 is a perspective view of a segment of a wall structure formed by the assembly on a footing or similar support of a plurality of channel members and foam plastic blocks shown in FIG. 1.

Wall structures are formed by assembling the channel members 10 and blocks 12 in horizontal layers. A bottommost one 48' is shown in FIG. 2. The blocks 12 are assembled with the end surfaces 24 of next-horizontally adjacent blocks abutting one another. The external surfaces 22 are aligned in a common plane. A length of channel member 10 is placed on the top surfaces 26 of each of the blocks, with the flat bottom wall 14 abutting and mating with the flat top surface 26. The channel openings 20 in the bottom wall 14 of the channel member are aligned with the block openings 30 in each of the blocks. Since the intervals between each of the openings 20 correspond with the intervals between the block openings 30, alignment is readily accomplished. A predetermined number of lengths of channel member 10 are employed to extend along the full length of the wall structure being formed. In the embodiment shown in FIGS. 1 and 2, the width of the channel member 10 is equal to the width of the blocks 12. Thus, the exterior surfaces of the side walls 16 also fall within the common planes defined by the surfaces 22. The channel members 10 can be fastened to the top walls 26 of the blocks 12 by extending sharp, narrow fasteners, such as nails (not shown), through the bottom wall 14 into the material of the block 12.

A bottommost horizontal layer 48' of the wall structure is initiated by positioning the first horizontal layer of blocks 12 on a footing 32, as is illustrated in FIG. 2. The footing 32 is of conventional poured concrete design, which preferably includes a plurality of steel reinforcing members or bars or rods 34 extending along the length of the footing 32. In addition, vertically-extending reinforcing members or bars or rods 36 are positioned in alignment in the concrete footing 32 at intervals equal to the intervals between the openings 30. The reinforcing rods 36 extend into the block openings 30 upwardly past the bottom wall 28 of each block 12. Preferably, reinforcing rods 36 extend into all of the block openings 30 in the lowermost layer 48'. To help align the blocks 12 on the footing 32, a board 38 or other similar elongated, straight member can be temporarily connected to the concrete footing, and the blocks 12 are positioned against the board 38 and retained in that position by friction. Once the bottommost layer has been completed, the board 38 can be removed.

Figure 3:
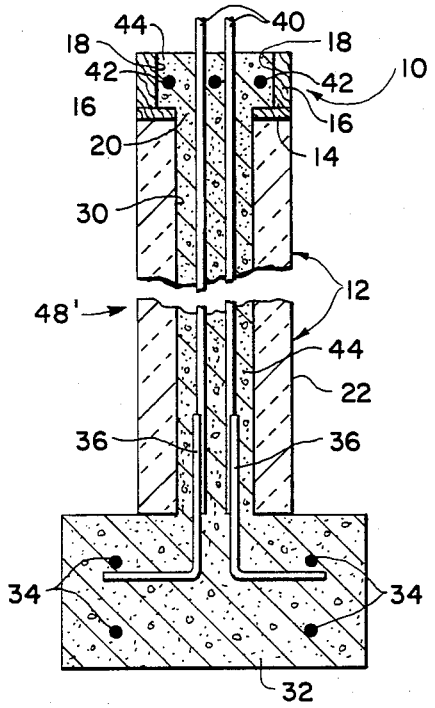
FIG. 3 is a vertical section view viewed along the longitudinal dimension of the wall segment of FIG. 2, additionally illustrating concrete filling the concrete confining openings of the plastic block and the U-shaped channel of the channel member.
Figure 4:
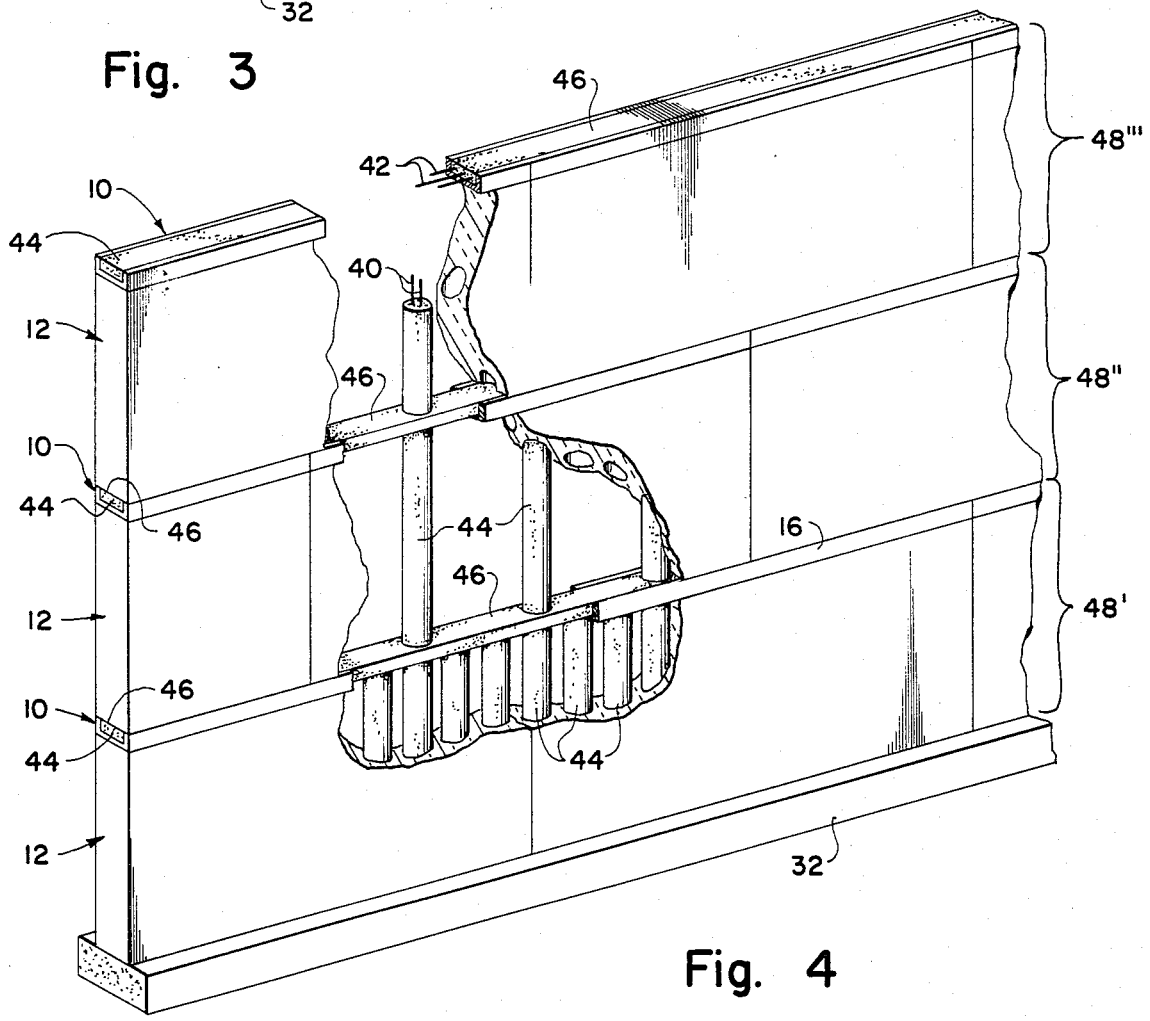
FIG. 4 is a perspective view of a wall structure, with a portion broken away to illustrate internal elements thereof.

To provide additional rigid support for the concrete which will ultimately occupy the block openings 30 in the blocks 12 and in the U-shaped channel 18 in the channel member 10, vertical reinforcing members or bars or rods 40 are positioned into at least some or all of the block openings 30, as is shown in FIGS. 3 and 4. In those horizontal layers 48' (FIG. 4) which are below grade, or the surface of the earth, it is desirable to fill each longitudinally-spaced block opening 30 with at least one reinforcing rod 40 and concrete. In those horizontal layers above grade, e.g. 48'' and 48''', it is generally sufficient if every third longitudinally-spaced opening 30 is filled with a reinforcing rod 40 and concrete. The interval between openings 30, and the member of these openings 30 which are filled with concrete and reinforcing rods, are engineering matters determined in accordance with the desired strength to be achieved in the wall structure. In addition, horizontal reinforcing members or bars or rods 42 are placed in the channels 18 of all of the channel members 10 in each horizontal layer. The reinforcing rods 40 in the openings 30 of the lowermost layer 48' can be suitably connected to those rods 36 extending from the footing 32, or at least a suitable overlap is provided, as is known in the art. The horizontal reinforcing rods 42 can similarly be connected to one or more of the vertically-extending reinforcing rods 40 within the U-shaped channel 18.

Fluid concrete 44 is poured into the U-shaped channel 18 of each channel member 10 after the reinforcing rods 40 and 42 have been inserted and properly connected. The U-shaped channel 18 serves to confine and hold the concrete 44 and funnel it into the openings 20 and 30. The block openings 30 confine the concrete until it hardens.

Once all of the openings 30 in the blocks 12 of the lowermost layer 48' have been completely filled with concrete, the U-shaped channel 18 of the channel member 10 of the layer 48' is likewise filled with concrete until the upper surface of the concrete reaches the upper edge of the side walls 16. A horizontally-extending, generally smooth upper surface 46 is formed by the concrete 44, and reinforcing rods 40 at predetermined locations are allowed to extend above the surface 46. The fluid concrete 44 in the lowermost layer 48' thereafter begins setting up or hardening.

After the concrete in the lowermost layer 48' has hardened sufficiently, the next vertical horizontal layer 48'' is built up by placing the blocks 12 on top of the concrete surface 46 of the lowermost layer 48' and by placing the channel member 10 on the top surface 26 of the blocks 12 of the layer 48''. In the second layer 48'', and in the layers 48''', etc., thereabove, only selected openings 30 are filled with concrete 44 and reinforcing rods 40. Openings 20 (FIG. 1) are formed into the channel members 10 at locations which align with those openings 30 which are to be filled with concrete. No openings 20 in the bottom wall 14 (FIG. 1) of each channel member are formed in alignment with those openings 30 which remain open and unfilled with concrete. The vertical reinforcing rods 40 extend upward from the concrete surface 46 in the channel member 10 of the layer 48' only at the predetermined locations in the layers 48'' and 48''', etc., where continuing vertical support columns are to be located. As a result of being able to selectively determine which openings are to be filled with concrete, a substantial savings in the amount of concrete results as compared to prior certain plastic block and poured concrete techniques where the openings and interfitting relationship of the plastic blocks require all the interior openings to be filled with concrete.

After the concrete in the second layer 48'' has hardened, the third layer 48''' is built up and poured with concrete in the same manner as described. In those horizontal layers above the second layer 48'', the concrete is poured only into those openings 30 vertically aligned with those openings 30 in the next lower level. In this manner, the resulting vertical support columns rest on top of one another to maintain the strength of the poured-concrete and rod-reinforced structure.

A plurality of vertically-extending, generally cylindrical load-bearing or support columns are formed by the hardened concrete in the block openings 30, as shown in FIG. 4. Similarly, a plurality of generally horizontally-extending structural support beams are provided by the hardened concrete in the U-shaped channel 18. Thus, a rigid horizontal and vertical support structure is achieved in the wall structure without undue complication common in prior art plastic blocks which attempt to achieve both vertical and horizontal concrete support structures from the internal openings in the block itself. Instead, the present invention utilizes only the hardened concrete and reinforcing rods in the block openings 30 in the block 12, which are relatively easily formed and convenient to fill from above with concrete, to achieve vertical load-bearing support, and utilizes the hardened concrete and the reinforcing rods in the channel member 10, with its attendant improvements in wall structure assembly and concrete pouring and exterior material connection, among others, to achieve horizontal load-bearing support.

Figure 5:
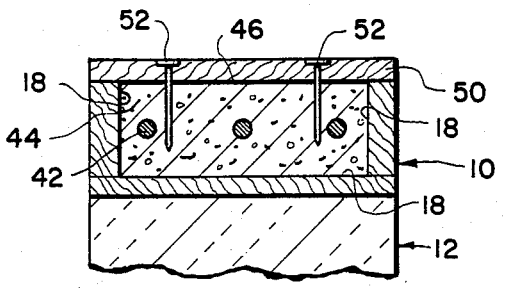
FIG. 5 is a vertical section view through a top portion of a wall structure, illustrating a top plate member attached to the uppermost channel member of the wall structure.

Multiple layers of channel members 10 and blocks 12 typically complete the wall structure. The horizontal layers, each designated 48 in FIG. 4, are set up and poured one at a time in the manner described. However, no reinforcing rods 40 are allowed to extend above the upper smooth surface 46 of the concrete 44 in the uppermost channel member 10, shown in FIG. 5. Instead, a top plate member 50 is anchored to the concrete 44 in the uppermost U-shaped channel 18 by extending nails or other types of attachment means 52 from the top plate 50 down into the concrete in the channel 18. Thereafter, rafters or other ceiling support members can be conveniently attached to the top plate member 50 in one of the known techniques. Of course, the top plate 50 will typically be a wooden board.

If lateral support for the wall structure shown in FIG. 4 is desired during construction, the support members can be conveniently attached or nailed to the side walls 16 of the channel members 10 and extended downward and outward to the ground or other support in a triangular-like manner. In many cases, however, segments of the wall structure will intersect one another and the intersection itself will provide the needed degree of lateral support for both segments of the wall structure.

Figure 6:
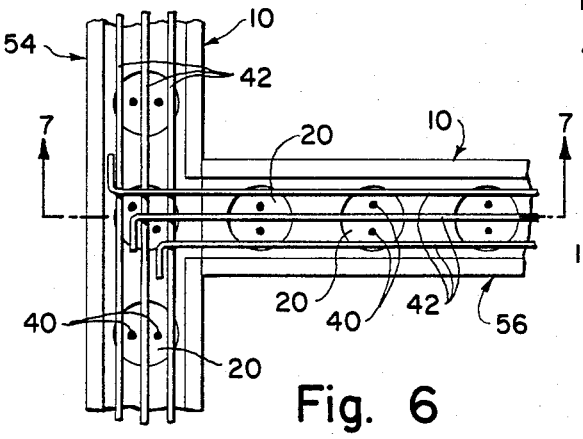
FIG. 6 is a partial horizontal section view viewed along the vertical or height dimension of a wall structure wherein two wall structures are joined together at an angle.
Figure 7:
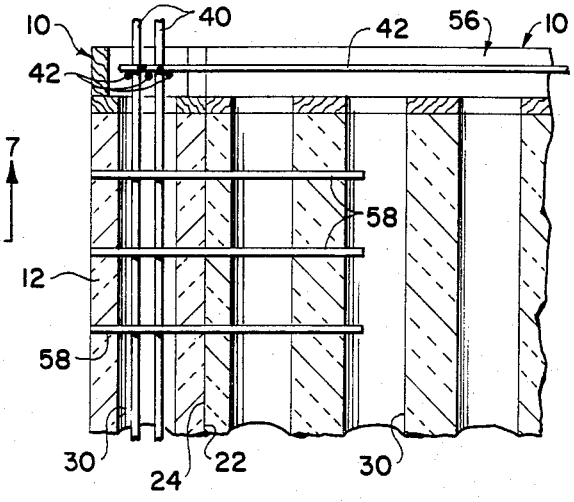
FIG. 7 is a vertical section view taken substantially in the plane of line 7—7 of FIG. 6.

An exemplary method of joining wall structures at angles is illustrated in FIGS, 6 and 7. Wall structure 54 joins the wall structure 56 at a right angle as shown in FIG. 6. To open the U-shaped channels of the channel members 10 of the wall structures 54 and 56 to one another, a segment of the adjoining side wall 16 of the channel member 10 in the wall structure 54 is omitted. The horizontal reinforcing rods 42 from within the U-shaped channel of the channel member 10 of the wall structure 56 are bent at right angles to intersect and preferably connect with the reinforcing rods 42 in the U-shaped channel of the channel member 10 of the wall structure 54. Consequently, when the concrete is poured in the channels of the channel members 10 of the wall structures 54 and 56, it solidifies into an integral T-shaped horizontal beam at the intersection. In addition, other linking reinforcing members or rods 58 may be employed at the junction of the wall structures 54 and 56 as shown in FIG. 7. The linking reinforcing rods 58 are driven or pushed through the exterior walls 22 of the block 12 of the wall structure 54, and into the end wall 24 of the block 12 of the wall structure 56. The linking rods 58 extend between at least one block opening 30 in each block of the wall structures 54 and 56 at a height position above and/or below the channel member 10. Thus, when the concrete in the block openings 30 solidifies, a rigid linkage through the linking rods 58 extends between the wall structures 54 and 56 substantially along the full vertical height of the layer.

Figure 8:
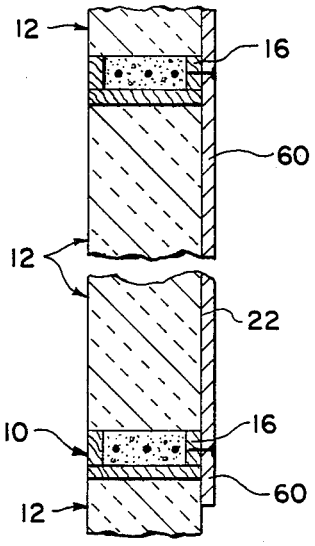
FIG. 8 is a partial vertical section view viewed in a longitudinal dimension of a wall structure, illustrating one exemplary connection of exterior materials to the channel members.

The convenience of attaching exterior members to the completed wall structure is illustrated in FIG. 8. A member 60, such as wallboard or drywall, can be conveniently nailed into the side wall 16 of the channel member 10. Thus, the side wall 16 serves as means for attaching fasteners to the completed wall structure. In a similar manner, other types of hangers and similar devices can be attached to the channel members 10. If necessary or desired, the member can be glued to the exterior surface 22 of the blocks 12 at predetermined intervals.

Figure 9:
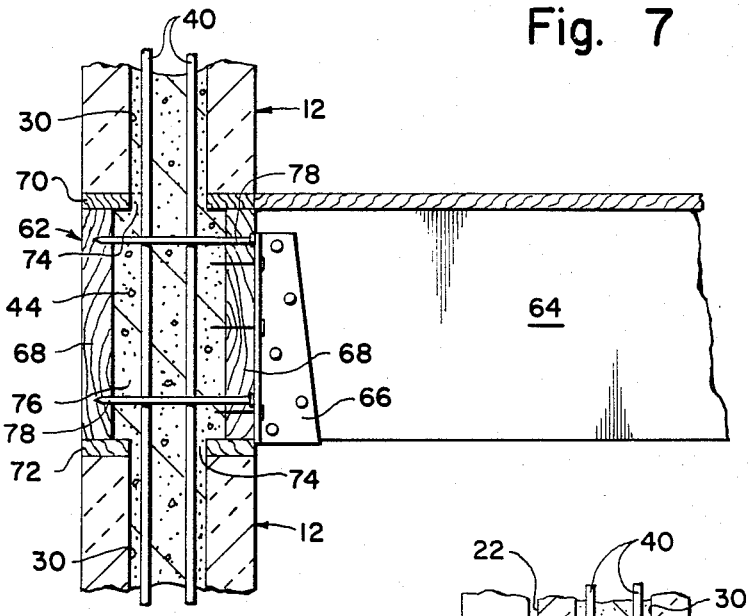
FIG. 9 is a vertical section view of a beam channel member in a wall structure viewed along the longitudinal dimension of the wall structure and illustrating the connection of a substantial support element to the channel member.

In the case, however, where a relatively heavy element, such as a floor joist 64, is to be attached to the wall structure, as shown in FIG. 9, or in other desireable situations, a beam channel member 62 is utilized in constructing the wall structure. The beam channel member 62 is preferably formed of wood, such as pressure-treated plywood and lumber, which allows the ready connection thereto of substantial connecting members, such as joist hangers 66. The beam member 62 is formed by a pair of parallel, vertically-extending exterior side walls 68 and a top and a bottom horizontally-extending wall 70 and 72, respectively. Cylindrical channel openings 74 are formed in the top wall 70 and bottom wall 72 at intervals to align with the openings 30 in the blocks 12 above and below the beam channel member 62 which are to be filled with concrete. The vertical reinforcing rods 40 extend through the openings 74. When poured concrete 44 has solidified, the hollow interior 76 of the beam member 62 is completely filled with concrete to define a substantial horizontally-extending beam. The joist hangers 66 are thereafter nailed or otherwise fastened to one of the exterior surfaces of one of the side walls 68. The joists 64 are supported and connected to the joist hangers 66 in the conventional manner. It should be noted that the beam channel member 62 need not be formed with the top wall 70 connected to the side walls 68 prior to filling its hollow interior 76 with concrete 44. Instead, the beam channel member 62 can be filled completely with concrete 44 before the top wall 70 is attached to the side walls 68. If additional load bearing support is desirable, spikes 78 can be driven through one side wall 68 into the opposite side wall, prior to filling the interior 76 with concrete 44. The spikes 78 act as members which connect the side walls together and support the side walls from the hardened concrete in the interior 76. In certain circumstances, it may be possible to avoid connecting the top wall 70 to the beam channel member 62, in which case the beam channel member 62, without the top wall 70, functions as a vertically-extended version of the U-shaped channel member 10. In other circumstances, it may be desirable to connect a top wall to the U-shaped channel member 10, in which case each of the channel members 10 assumes the appearance of reduced-height version of a beam channel member 62.

Figure 10:
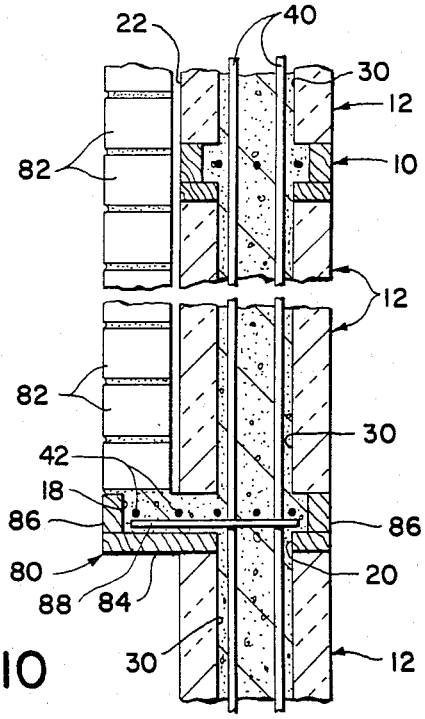
FIG. 10 is a partial vertical section view viewed along the longitudinal dimension of a wall segment, illustrating the construction of a supporting shelf or ledge by use of the channel members of the present invention.

The manner by which the U-shaped channel members are employed as a shelf or horizontal support for an exterior brick wall or the like is illustrated in FIG. 10. An extended width shelf support channel member 80 is inserted in the wall segment at the vertical height or level where it is desired to commence the upward extension of the wall of bricks 82 or the like. The shelf support channel member 80 is formed by a bottom wall 84 having a width substantially greater than the width of the blocks 12 and by side walls 86 which extend upward from the outer longitudinal edges of the bottom wall 84. The width to which the shelf support channel member 80 extends outward from an exterior surface 22 of the blocks 12 is sufficient to accommodate the bricks or other items to be attached. Channel openings 20 are formed in the bottom wall 84 to align with the openings 30 in the vertically adjacent blocks 12. Additional horizontal reinforcing rods 42 extend outward into the extended width U-shaped channel 18 provided by the shelf support channel member 80. Additional reinforcing members, such as rods 88, extend into the extended U-shapod channel 18. In this manner, interior load-bearing structural supports are provided around which the concrete 44 can solidify in the extended width channel 18. Once the concrete 44 has hardened, the bricks 82 can be layed up from the resulting concrete shelf extending outward from the surface 22 of the plastic blocks 12.

The use of the channel members 10, 62 and 80 makes it possible to conveniently employ the well known normal types of construction in conjunction with plastic block and poured concrete method of wall structure construction. Various wall cover materials can be quickly, conveniently and accurately placed over the exterior surfaces 22 of the formed wall segments. Internal structural elements, such as floor and ceiling joists, are readily attached. Exterior facing elements, such as a brick wall, are conveniently constructed. The single-piece integral plastic blocks provide good strength to prevent bulges and leaks as the concrete is poured into the block openings. The fluid concrete is quickly and conveniently funneled into the block openings by the U-shaped channel members, and is confined to the block openings and channel members without dependence on an interfitting relationship of the foam plastic blocks. Since the end surfaces of the plastic blocks abut one another without necessity for any specific type of interlocking or interfitting relationship, due to the interval spacing of the block openings 30, no difficulty is encountered in assembling the blocks in order to pour the concrete. Adjustments in the length of the blocks and the channel members are conveniently made by cutting both elements. Many other advantages are apparent from a full comprehension of the present invention.

Preferred embodiments of the present invention have been described with a certain degree of particularity. It should be understood, however, that changes in details may be made without departing from the invention as defined by the scope of the appended claims.

What is claimed is:

1. A wall structure, comprising:

a plurality of foam plastic blocks, each block having a length and a height and a width dimension, each block having a top and a bottom surface extending in the longitudinal and width dimensions and separated from one another by the height dimension, each block positioned in said wall structure with its height dimension extending generally vertically and its longitudinal and width dimensions extending generally horizontally, each block having within its interior a plurality of block openings extending between its top and bottom walls, each of the block openings located at predetermined locations in the top surface along the longitudinal dimension of the block;

a channel member abutting the top surface of each block along substantially the full extent of the longitudinal dimension of each block, said channel member comprising a bottom wall and a pair of side walls extending upward from the bottom wall, the channel member thereby defining a U-shaped channel between the side walls and the bottom wall, the bottom wall having a configuration adapted to generally mate with the top wall of each block, said bottom wall having a plurality of channel openings therethrough at predetermined locations which correspond with the predetermined locations of the block openings in the top surface of each block with which the top surface mates, said side walls characterized by the capability to receive and retain fasteners inserted therein from an exterior surface extending in the height and length dimensions of said wall structure, the fasteners adapted for attaching construction elements to said wall structure; and load-bearing concrete substantially occupying the block and channel openings and the U-shaped channel.

2. A wall structure as defined in claim 1 further comprising:

at least one reinforcing member extending in the length dimension within the U-shaped channel and embedded in the concrete occupying the U-shaped channel.

3. A wall structure as defined in claims 1 or 2 wherein the lower surface of at least one block rests on an upper surface of the concrete occupying the U-shaped channel.

4. A wall structure as defined in claim 3:

wherein at least some of the block openings formed in two vertically oriented blocks are aligned with one another, and further comprising at least one reinforcing member extending from within the block opening of a lower block through the channel opening in the bottom wall and through the U-shaped channel and into the vertically-aligned block opening of an upper block.

5. A wall structure as defined in claims 1 or 2 further comprising:

at least one reinforcing member extends vertically within each of at least a few of the block openings of said blocks and into the U-shaped channel.

6. A wall structure as defined in claim 5 wherein:

each block has opposite end surfaces extending generally in the plane of the height and width dimensions and separated by the longitudinal dimension, the end surfaces of two horizontally next adjacent blocks abut one another, and the lower surfaces of the horizontally adjacent blocks rest at least in part on said channel member.

7. A wall structure as defined in claim 6 wherein the abutting end surfaces of the two horizontally next adjacent blocks are substantially free of any interconnection between the foam plastic of the two blocks.

8. A wall structure as defined in claim 6 wherein:

each block has opposite exterior surfaces extending generally in the plane of the height and longitudinal dimensions and separated by the width dimension, the exterior surfaces of the horizontally next adjacent blocks and the vertically adjacent blocks are generally positioned in at least one common plane, and an exterior surface of at least one side wall of said channel member also extends substantially in the one common plane.

9. A wall structure as defined in claim 8 wherein:

the exterior surfaces of the next horizontally adjacent and the vertically adjacent blocks are positioned in common planes on opposite sides of said wall structure, the exterior surfaces of both side walls of said channel member extend substantially in the common planes on opposite sides of said wall structure.

10. A wall structure as defined in claim 8 wherein:

said channel member operatively positions a portion of the U-shaped channel and the concrete occupying the U-shaped channel substantially exteriorly out of and away from the common plane on one side of said wall structure.

11. First and second wall structures, each of which as defined in claim 8, joined at a predetermined angle, wherein:

the channel members of the first and second wall structures abut one another at the predetermined angle, one side wall of the channel member of the first wall structure includes an opening therethrough into the U-shaped channel of the channel member of the second wall structure, and at least one reinforcing member extends from the U-shaped channel of the channel member of one wall structure into the U-shaped channel of the channel member of the other wall structure, and an integral piece of concrete occupies the U-shaped channels of the abutting channel members of both wall structures.

12. Joined wall structures as defined in claim 11 further comprising:

at least one additional reinforcing member extending from within the block opening in one block in one wall structure into at least one block opening in another block in the other wall structure.

13. A wall structure as defined in claim 1 wherein each foam block is of integral, single-piece construction.

14. In a wall structure comprising blocks formed at least in part of foam plastic, each block having opposite exterior surfaces extending in a longitudinal and height dimension, the opposite exterior surfaces generally separated by a width dimension, each block also including at least one vertically extending block opening therein which is interiorly spaced from the exterior surfaces, load-bearing concrete occupying the block openings of the blocks, and an improvement comprising:

a member contacting at least one block and extending in the width dimension from one exterior edge thereof adjacent one exterior surface of the one block to the opposite exterior edge thereof adjacent the other opposite exterior surface of the one block, said member also extending in a longitudinal dimension a predetermined distance, said member including means defining at least one member opening therein interiorly spaced from its outer periphery in the longitudinal and width dimensions, the member opening in said member extending vertically through said member, said member located with the member opening generally vertically aligned with the block opening in the one block, and the concrete occupying the block opening of the one block also extending substantially into the opening in the member to permanently retain the member rigidly in position relative to the one block in said wall structure, said member characterized by the capability to receive and retain fasteners inserted in the exterior edges thereof to attach construction elements to said wall structure.

15. An invention as defined in claim 14 wherein the one block further includes a top surface extending between the exterior surfaces in the longitudinal and width dimensions, and said member further contacts the top surface of said one block substantially along the full length of the top surface in the longitudinal dimension.

16. An invention as defined in claim 15 wherein said member further includes a plurality of said openings through said member, said openings spaced longitudinally along said member at predetermined intervals.

17. An invention as defined in claim 16 wherein said member comprises a bottom wall contacting the top surface of the one block and at least one side wall extending upward from the bottom wall adjacent the exterior surface of the one block.

18. An invention as defined in claim 17 wherein said side wall is characterized by the capability to receive and retain the fasteners.

19. An invention as defined in claim 18 wherein said member comprises a pair of side walls spaced apart in the width dimension and extending upward from the bottom wall, the spaced upward extending side walls and the bottom wall defining a U-shaped channel, the member openings extending into the U-shaped channel, and the U-shaped channel also containing concrete integral with the concrete occupying the block openings.

20. An invention as defined in claim 19 wherein said wall structure further includes another said block, the another block also including a bottom surface abutting the upper surface of the concrete in the channel.

21. An invention as defined in claim 20 wherein said U-shaped channel and the concrete occupying the U-shaped channel extend exteriorly out and away from one exterior surface of the another block.

22. An invention as defined in claim 21 wherein each block is of integral, single-piece construction.

23. Wall structure construction elements for use in conjunction with load-bearing means including concrete for constructing a wall structure comprising:

a block of right rectangular configuration formed by an integral single piece of foam plastic, said block defining two planar opposite exterior surfaces extending in a longitudinal and a height dimension and separated by a width dimension, a planar top and an opposite planar bottom surface extending in the longitudinal and width dimensions and separated by the height dimension, and two opposite planar end surfaces extending in the height and width dimensions and separated by the longitudinal dimension, said block further including a plurality of block openings extending in the height dimension between the top and bottom surfaces and spaced in the width dimension between the two exterior surfaces, the block openings positioned at predetermined intervals along the longitudinal dimension, the block openings adapted to contain concrete therein; and a U-shaped channel member comprising a pair of side walls and a bottom wall connected to and extending between the side walls, the bottom wall adapted to contact and extend longitudinally along the top surface of said block, the side walls extending in the height dimension above the bottom wall, the side walls and bottom wall defining a U-shaped channel adapted to be filled with concrete, the bottom wall including a plurality of channel openings formed therethrough at predetermined intervals in the longitudinal dimension corresponding to the predetermined intervals at which block openings are positioned, the channel openings aligning with the block openings when the bottom wall contacts the top surface, an exterior surface of at least one side wall adapted to extend generally in the plane of one exterior surface of the block when the bottom wall contacts the top surface and the block and channel openings are aligned, the U-shaped channel also operative for funneling fluid concrete during construction into the block and channel openings, at least one of the side wall or exterior edge portions of the bottom wall from which the side walls extend upward being characterized by the capability to receive and retain fasteners inserted therein from the exterior surface for the purpose of attaching construction elements to the wall structure.

24. Wall structure construction elements as defined in claim 23 wherein said side walls comprise wooden material.

25. Wall structure construction elements as defined in claim 23 wherein said bottom wall and said side walls are formed of pressure-treated plywood.

26. A method of constructing a wall structure upward from a support, comprising:

placing a foam plastic block on the support, the block having an exterior surface extending in a longitudinal and a height dimension, the block having a plurality of longitudinally spaced and height-wise extending block openings formed completely therethrough, the block also having a top surface extending therealong in the longitudinal and the width dimension;

placing a channel member on the top surface of the block member, said channel member having a bottom wall and a pair of side walls connected to and extending upward from the bottom wall to define a U-shaped channel, the bottom wall having a plurality of channel openings formed therethrough at predetermined locations to align with predetermined block openings;

placing at least one reinforcing member in the U-shaped channel and in at least some of the block openings and the channel openings;

flowing fluid concrete into the U-shaped channel;

filling the aligned block openings to their complete height with fluid concrete by steps including funneling the fluid concrete from the U-shaped channel through the channel openings into the block openings;

filling the U-shaped channel with fluid concrete;

allowing the fluid concrete to harden.

27. A method as defined in claim 26 further comprising:

filling the U-shaped channel substantially full of concrete to the upper extent of the side walls.

28. A method as defined in claim 27 further comprising:

placing another said foam plastic block on top of the channel member after the U-shaped channel has been filled with concrete.

29. A method as defined in claim 28 further comprising:

aligning the block openings of the another block with the block openings of the block beneath that U-shaped channel member upon which the another block is placed.

30. A method as defined in claim 26 further comprising:

placing a top wall on the side walls of the channel member.

31. A wall structure as defined in claims 1, 19 or 23 wherein said channel member further comprises a top wall operatively connected to and extending between the side walls at a position spaced above the bottom wall in the height dimension.

32. A wall structure as defined in claim 31 wherein the upper wall includes openings formed therethrough at predetermined locations in alignment with the opening in the bottom wall.

* * * * *